US006968634B2

(12) United States Patent
Dombowsky

(10) Patent No.: US 6,968,634 B2
(45) Date of Patent: Nov. 29, 2005

(54) RESILIENT STRAP-ON SOLE COVER

(76) Inventor: Ben Dombowsky, 1182 Adler Avenue, Moose Jaw, Saskatchewan (CA), S6H 0Y7

( * ) Notice: Subject to any disclaimer, the term of this patent is extended or adjusted under 35 U.S.C. 154(b) by 109 days.

(21) Appl. No.: 10/385,294

(22) Filed: Mar. 11, 2003

(65) Prior Publication Data

US 2003/0230006 A1 Dec. 18, 2003

(30) Foreign Application Priority Data

Mar. 11, 2002 (CA) ..... 2375704

(51) Int. Cl.[7] ..... A43B 3/12; A43B 3/10; A43B 3/26

(52) U.S. Cl. ..... 36/11.5; 36/7.5; 36/97; 36/7.1 R

(58) Field of Search ..... 36/11.5, 7.5, 97, 36/96, 7.1 R, 7.4, 7.7, 7.3, 7.1 A

(56) References Cited

U.S. PATENT DOCUMENTS 2,260,138 A * 10/1941 Feinberg ..... 36/7.7
2,785,481 A * 3/1957 Joseph ..... 36/7.3
3,486,248 A * 12/1969 Iversen et al. ..... 36/7.3
3,559,309 A * 2/1971 Taylor ..... 36/7.3
3,863,272 A * 2/1975 Guille ..... 36/9 R
4,217,704 A 8/1980 Whitaker
4,434,565 A 3/1984 Haley
4,751,784 A * 6/1988 Petker et al. ..... 36/9 R
4,924,608 A 5/1990 Mogonye
5,228,216 A * 7/1993 Sargeant ..... 36/11.5
5,259,125 A * 11/1993 Gromes ..... 36/7.5
5,709,042 A * 1/1998 Houdroge ..... 36/7.5
5,794,368 A * 8/1998 Kirby ..... 36/7.5
5,836,090 A * 11/1998 Smith ..... 36/11.5
6,237,250 B1 * 5/2001 Aguerre ..... 36/11.5
2003/0106241 A1 6/2003 Marden et al.

* cited by examiner

*Primary Examiner*—Anthony Stashick
(74) *Attorney, Agent, or Firm*—Adrian D. Battison; Michael B. Williams; Ryan W. Dupuis

(57) ABSTRACT

A resilient anti-fatigue layer shaped to fit under the sole and heel of a shoe of a wearer includes a mat of fibers heat bonded together with a tight surface against the sole and a loose surface against the floor. The mat of fibers includes a generally flat portion shaped to match the bottom of the shoe and a plurality of tabs formed of the mat at the edges of the bottom portion and projecting beyond the edges of the bottom portion with at least one tab at the front, two tabs at the rear and at least one tab at each side, with each tab having attached thereto a respective strap. The straps provide a on each side a single strap which extends from the front side connection tab, through slots provided in a toe connection member to the rear side tabs, to the heel tabs and over the foot.

20 Claims, 6 Drawing Sheets

RESILIENT STRAP-ON SOLE COVER

The present invention relates to a resilient sole cover which can be strapped onto the shoe of a wearer for purposes of providing a resilient layer between the shoe and a hard floor.

BACKGROUND

There has been much research that shows a direct relationship between comfort, safety, and productivity in the workplace. In situations where long periods of standing exist, worker discomfort and fatigue can negatively impact productivity, absenteeism, and healthcare costs-. Standing requires about 20 percent more energy than sitting. The foot is a very complex organ, a structure of 25 bones, or 12.5% of all the bones in the entire body, 56 ligaments, 38 muscles and over 7000 nerve endings. It is essential to recognize that your feet are sensitive parts of your body deserving good care. Being farthest from the heart, the feet generally have the poorest circulation in the body and this diminishes with age Depending on the floor surface and the amount of time workers are standing, employees can 'feel drained' and experience poor blood circulation in feet and legs. This may lead to serious consequences for health and safety at the work place. Beyond discomfort, pain and fatigue sets up the worker for further injuries affecting the muscles and joints. In addition an employee who is suffering from pain and fatigue is less alert and more likely to act in an unsafe manner.

Anti-fatigue mats have been designed to provide effective shock attenuation to address this problem. These mats are made of various materials including rubber, vinyl, wood and carpeting materials. By alleviating pressure, it can help stimulate blood circulation and possibly reduce stress of the lower back, leg joints, and major muscle groups. The result is an improved workplace with fewer occupational health complaints.

One anti-fatigue mat is available from 3M which is formed of a layer of intermingled course strands of heat bondable flexible plastics or rubber material which fibers are bonded together at crossing points to form an interconnected mat. One surface of the layer is relatively flat and the bonding effect is more pronounced with some of the strands clearly melted in the bonding process to form a tight surface while the other surface is looser and the strands less bonded together so that the strands are loose at the surface and stand out from the surface. This mat is commercially available and widely used as a floor covering for commercial floors for purposes of reducing fatigue in workers required to stand and work on the floor for extended time periods. The mat is applied to the floor surface such as concrete with the tight surface in contact with the floor and the loose surface facing upwardly. This mat is resistant to wear and to damage from commercial use including material spills and thus is widely used.

However there are many locations where the mat cannot be used such as where there us considerable vehicular traffic, and thus in those locations the workers are obligated to work, stand and walk directly on the concrete floor with the consequential discomfort and fatigue which is widely documented.

SUMMARY

It is one object of the present invention to provide an improved apparatus which can be attached to the shoe of a wearer for providing a resilient surface thereon.

According to the present invention there is provided an apparatus comprising:

a resilient, flexible layer shaped to fit under the sole and heel of a shoe of a wearer;

and straps connected to a front end, a rear end and sides of the layer for wrapping around the shoe of the wearer for attachment of the layer to the foot of the wearer;

wherein the layer is formed of a resilient mat defined by resilient polymer fibers heat bonded together so that a bottom surface of the mat defined by the fibers engages the ground.

In one arrangement, the layer consists solely of the mat of fibers without any supporting materials or layers.

The layer is thus resilient in that it provides a cushioning effect through its thickness to assist in reducing shock and forces on the foot of the wearer.

The layer is also flexible in that it contains no rigid or stiffening elements which inhibit the ability of the layer to flex under the shoe of the wearer as the shoe flexes during movement of the wearer.

Alternatively, the mat of fibers is bonded to an upper resilient layer for engaging the bottom of the shoe.

In one embodiment, the upper resilient layer is a layer of rubber bonded to the fibers.

In another embodiment, the upper resilient layer is a coat into which the upper fibers are incorporated.

Preferably the mat of fibers includes a tight surface where the fibers are more tightly bonded together and a loose surface where the fibers include loose strands and wherein the loose surface is arranged to engage the ground.

According to a second aspect of the invention there is provided an apparatus comprising:

a resilient, flexible layer shaped to fit under the sole and heel of a shoe of a wearer;

and straps connected to a front end, a rear end and sides of the layer for wrapping around the shoe of the wearer for attachment of the layer to the foot of the wearer;

the resilient layer having thereon:

a toe connection member at a toe end;

two heel connection members at each side of a heel end;

two forward side connection members one on each side at a forward location on the side;

and two rearward side connection members one on each side at a location on the side rearward of the forward location;

the straps being arranged to connect to the connection members and to wrap around the foot of the wearer to hold the layer in place on the Preferably the toe connection member comprises a single member generally central of the toe end which extends from the layer over the toe rearwardly of the toe end to a rear strap engaging portion.

Preferably the rear strap engaging portion includes two connecting elements inclined to a center line such that strap portions attached thereto extend therefrom rearwardly and outwardly.

Preferably the two rear strap engaging portions comprise slots such that strap portions pass through the slots and extend from the forward side connection members to the rearward side connection members Preferably on each side a single strap connects the forward side connection member to the toe connection member and to the rearward side connection member and to the heel connection member.

Preferably on each side a single strap extends from the forward side connection member through a slot at the toe connection member, through a slot at the rearward side connection member, through a slot at the heel connection member and wraps over the shoe.

Preferably the toe connection member comprises a single member generally central of the toe end which extends from the layer over the toe rearwardly of the toe end to a rear connection portion.

Preferably the forward side connection members each include a portion which increases in width from the strap to the side of the layer so as to define a width at the layer which is wider than the strap to provide increased stability.

Preferably the rearward side connection members each include a ring connecting member defining a slot parallel to the layer.

Preferably the heel connection members each include a ring connecting member defining a slot parallel to the layer.

Preferably the ring connecting members of the heel connection members are attached to a strap which extends across the rear of the layer.

Preferably the layer has a length such that a rearmost part of the layer is pulled up behind the heel of the shoe and the heel connection members are arranged on each side of the heel.

According to a third aspect of the invention there is provided an apparatus comprising;

a resilient layer shaped to fit under the sole and heel of a shoe of a wearer, the layer having a plurality of holes therethrough;

straps connected to a front end, a rear end and sides of the layer for wrapping around the shoe of the wearer for attachment of the layer to the foot of the wearer;

and an anti-slip insert comprising a support sheet and a plurality of studs projecting from the support sheet to one side thereof, the support sheet being arranged to be located between the layer and the shoe with the studs projecting through the holes.

Preferably the studs have a length such that they just extend beyond the bottom surface of the layer such that the wearer is supported from the ground on both the studs and the resilient layer.

Preferably the sheet has a shape generally matching that of the layer.

The device described herein provides an innovative approach to help increase the effectiveness of an anti-fatigue matting program. The device described herein provides mobile matting. By strapping the device to the soles of the workers footwear the employee takes the mat with them. The elastic properties of the device resemble the natural springiness of a un-compacted soil, such as a farm field. Every foot movement with the device is absorbed by the 'give' in the soles to reduce any impact effects. It springs back to deliver that small amount of energy back to the feet. Wearing the device increases the employees comfort, while maintaining mobility so they can work longer without being restless, and will not be focusing on their next rest break or how long before they get to go home. If workers have full confidence that they will be safe, healthy and relatively comfortable at work, they will be more productive.

Designed to support an overall anti-fatigue strategy, the device is recommended to be used where employees are mobile, moving from station to station or where traditional anti-fatigue mats are not efficient or effective. For example, at a check out counter, a floor mat must be removed to accommodate cleaning cycles, increasing labor and strain for cleaning staff. With the device soles are simply removed and stored for next use. Different mobile mats suit different working environments so that different types and thickness of mat can be used.

BRIEF DESCRIPTION OF THE DRAWINGS

In the accompanying drawings, which illustrate an exemplary embodiment of the present invention.

DETAILED DESCRIPTION

The strap on sole is generally indicated at 10 and comprises a mat 11 and a series of straps 12.

Figure 6:
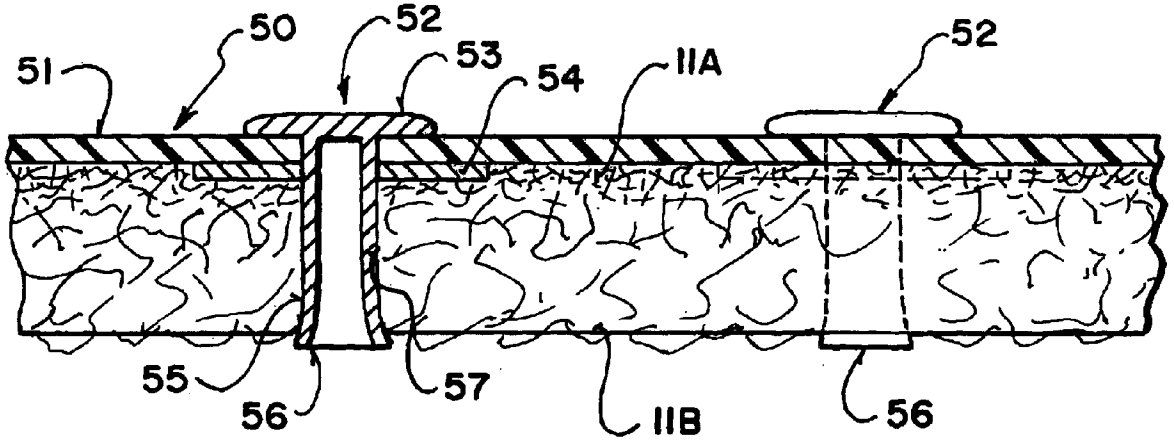
FIG. 6 is a cross sectional view of the embodiment of FIG. 1 showing an additional anti-slip insert.
Figure 7:
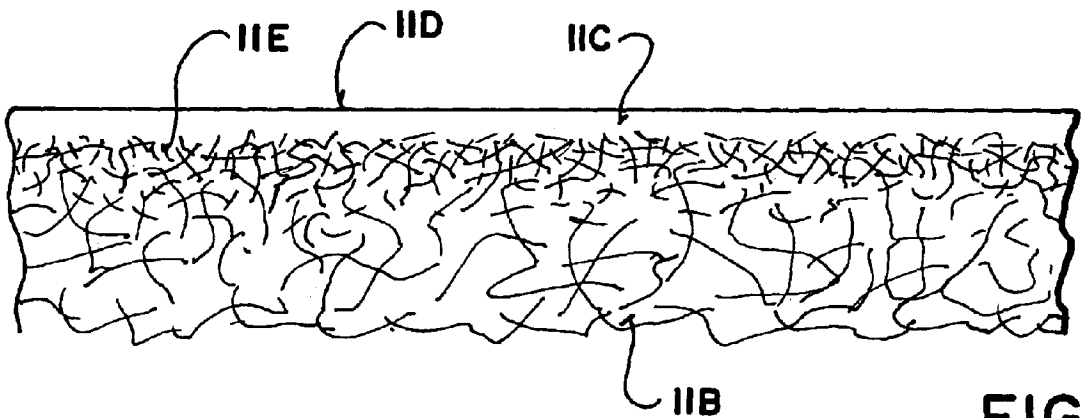
FIG. 7 is a cross sectional view of the embodiment of FIG. 1 showing a modified material.

The mat 11 is of the character previously described as shown in FIGS. 6 and 7 with a smooth or tight top surface 11A which engages the shoe of the wearer and thus faces upwardly in use and a lower loose surface 11B which is arranged for engaging the ground. The looser surface provides additional friction for the wear on the ground.

The mat is cut into the general shape of a shoe including a sole section 13 and a heel section 14. The mat is symmetrical so is usable on either foot. The mat thus has a peripheral edge 15 which defines the outer shape of the layer or mat or pad for lying underneath the foot of the wearer.

In practice, two different sizes can be provided including a smaller size which will match a range of shoe sizes of smaller size and a second size which can match a range of larger shoe sizes. It is thus not essential that the edge 15 is directly at the edge of the shoe, but it is desirable that it is close to the edge of the shoe. The thickness of the mat is of the order of half inch the thicker or thinner mat can also be used and are available. This mat therefore is resilient in that it can bend and fold but has sufficient stiffness that it takes up a generally flat shape underneath the sole.

Predicting beyond the peripheral edge 15 is provided a priority of tabs which extend outwardly. Each tab is generally rectangular in shape and is thus approximately 0.75 to 1.0 inches square to receive attach thereto the straps which are generally of the order of 0.5 to 0.75 inches in width.

Figure 8:
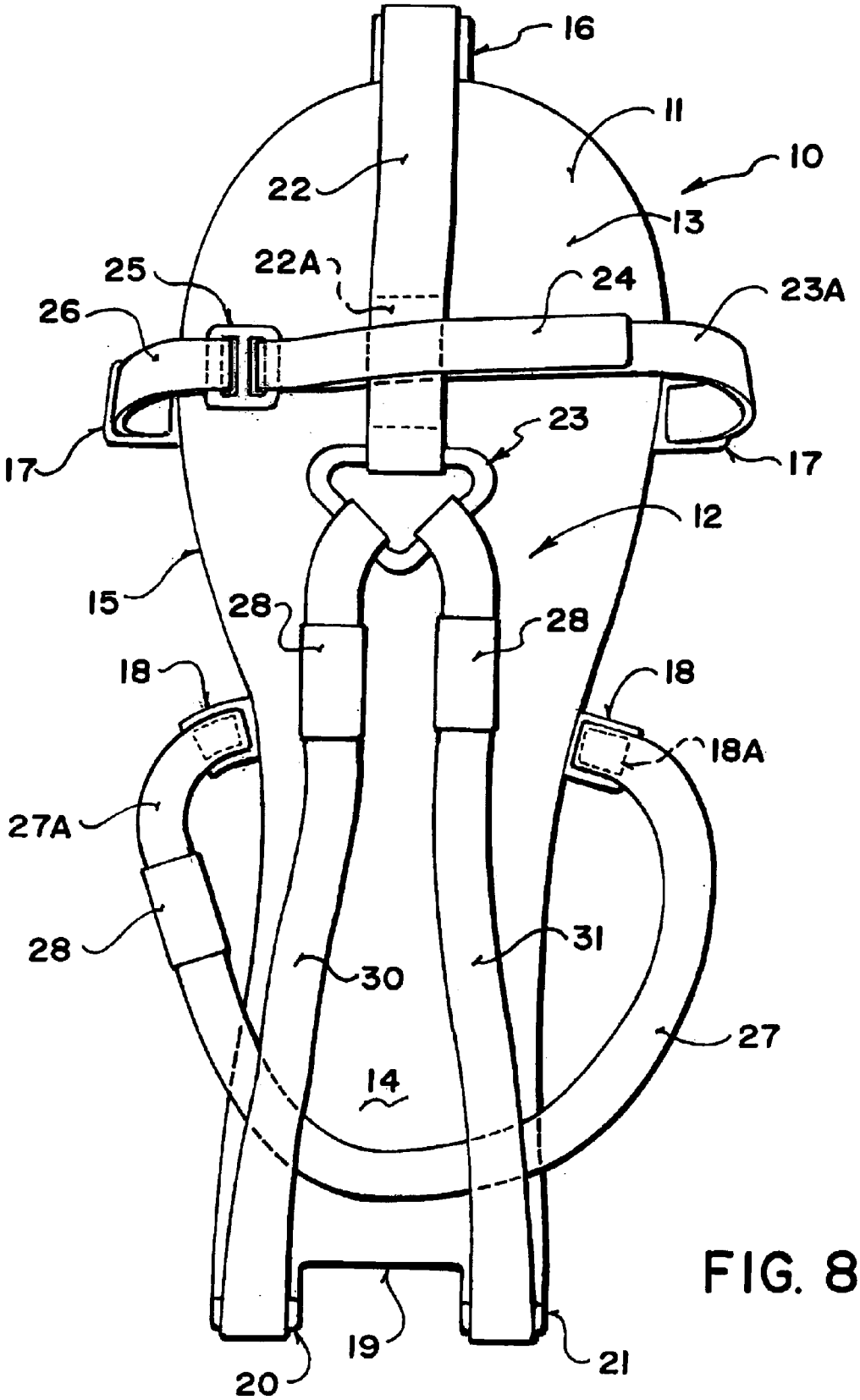
FIG. 8 is a top plan view of a second embodiment according to the present invention.

Turning firstly to the second embodiment shown in FIG. 8, at the front centre is provided a tab 16. Along each side is provided two tabs including a forward side tab 17 and a reward side tab 18. At the rear edge, the rear edge is straight across the rear of the mat as indicated at 19 and there provided two space tabs 20 and 21 at the end of the straight rear edge 19.

Figure 1:
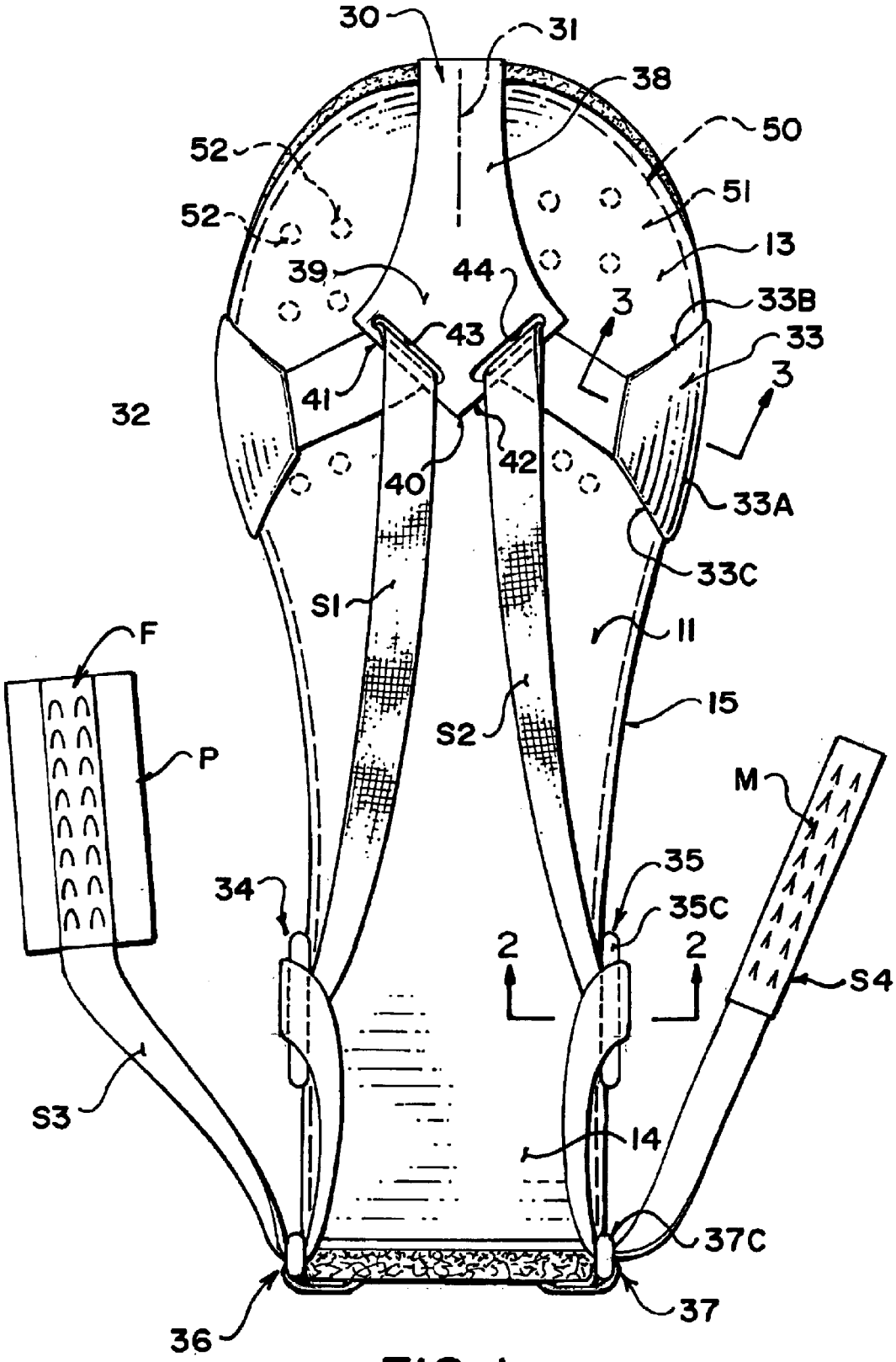
FIG. 1 is a top plan view of an embodiment according to the present invention.

To the front tab 16 as attached a front strap 22 which extends rearwardly to a triangular connector 23 to which is attached at one side. The front end of the strap 32 is stitched to the tab 16 from the underside, thus tending to pull the tab upwards so it projects upwardly out of the plane of the mat as shown in FIG. 1. The front strap 22 includes a loop 22A defined by an additional piece stitched on the under side. Connected across the tabs 17 is transverse front strap 23A including a hook and loop fastener section 24 which passes through a connector 25 and is looped back onto itself. The connector 25 is coupled to a further strap portion 26 which is stitched to the tab 17 on the other side. Thus the length of the forward transverse strap 23A can be increased or decreased by changing the lengths of the loop of the hook and loop connection section and pulling it through the connector 25. The strap 23A passes through the loop 22A and then passes over the top of the loop 22A so as to connect the strap 23A to the strap 22 and locate the strap 23A from moving forwardly or rearwardly.

At the tabs 18 is connected the rear strap 27 with a buckle 28 which allows the rear strap to be disconnected at the buckle and its lengths to be adjusted at the buckle. Such buckles are of course well known and conventionally available. A forward portion 27A of the strap extension the buckle to the tab 18 on the other side. The strap 27 then extends around the heal of the wearer and tends to lift the tabs and pull them upwardly and rearwardly. The strap portion 27 is stitched only to the bottom side of the tab 18 using stitches 18A. The strap portion 27A includes top and bottom straps connected to the top and bottom of the tab 18 and looped around a connector in the buckle 28.

The rear section of the mat is pulled upwardly onto the heel of the wearer so that the rear edge 19 lies across the rear of the heel rather than on the sole plate of the wearer. Then the tabs project upwardly and are pulled outwardly along each side of the shoe of the wearer by rear straps 30 and 31 which are stitched to the tabs 20 and 21 respectively. The straps 30 and 31 extend forwardly each on the respective side of the shoe on the wearer along the top of the shoe to the triangular connector 23 which is located on the arch of the foot of the wearer. The forward end of each of the straps 30 and 31 is connected to a respective side of the connector 23. Each of the straps includes a buckle 28 of the type which allows the strap to be disconnected and its length to be adjusted as previously described.

The matting material available from 3M is formed from loose strands of a polymeric or rubber material with the fibers or strands formed into loops where each loop is attached to next adjacent loops by a heat bonded effect. The matting provides an arrangement in which there is a side surface which is more bonded and therefore tighter and the second surface is very much looser allowing individual fibres or strands to be exposed at the surface with interstices between the strands. The strands have a thickness of the order of 1 mm and are formed of a material which is resistant to breakage when pulled with a relatively high extension to break.

The matting can be used solely as the mat layer itself formed solely from the fibres where the tighter side is indicated at 11A in FIG. 6 and a looser side is indicated at 11B.

However in order to provide a more substantial support for the fibres, the fibres can be bonded into a gel layer or coat 11C as shown in FIG. 7 where a coating is applied onto the tighter side of the matting which bonds into or absorbs some of the fibre parts so that the uppermost surface 11D of the coating is smooth without any fibres exposed and the fibres are attached into a lower surface 11E of the coating 11C. The coating can be formed of a gel formed from the same polymer as the fibres so that the gel bonds intimately to the outside surfaces of the fibres or may even melt the fibres to form an integral structure in which the fibres are attached and the lower part of the fibres extend into the loose surface 11D.

Figure 2:
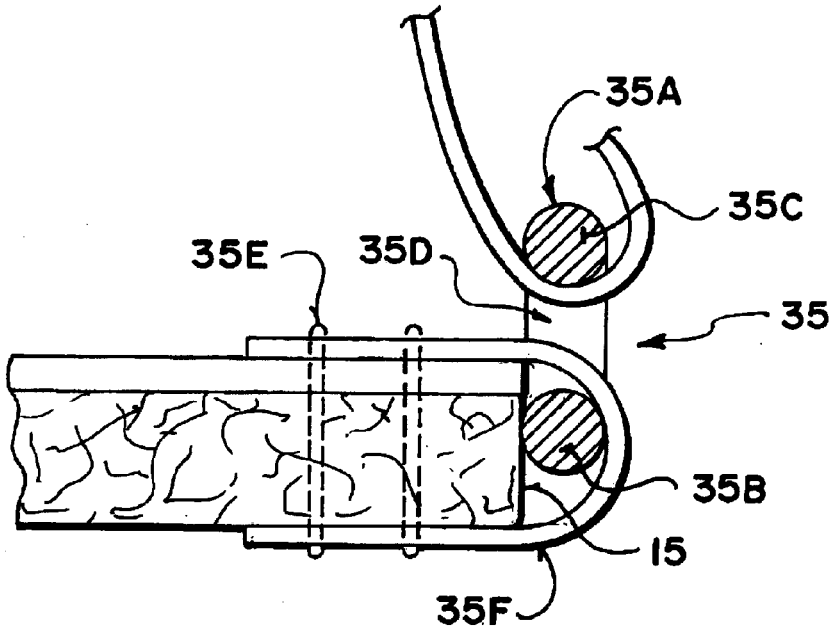
FIG. 2 is a cross sectional view along the lines 2—2 of FIG. 1.
Figure 3:
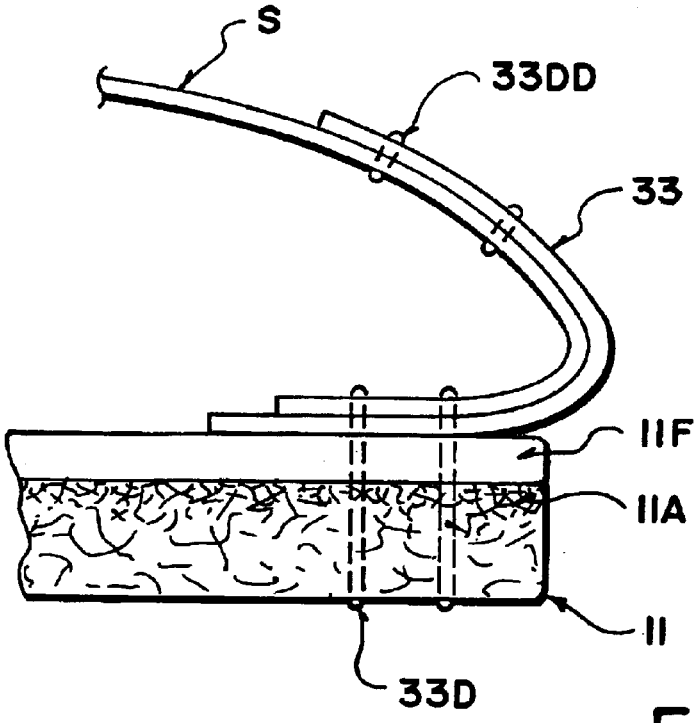
FIG. 3 is a cross sectional view along the lines 3—3 of FIG. 1.
Figure 4:
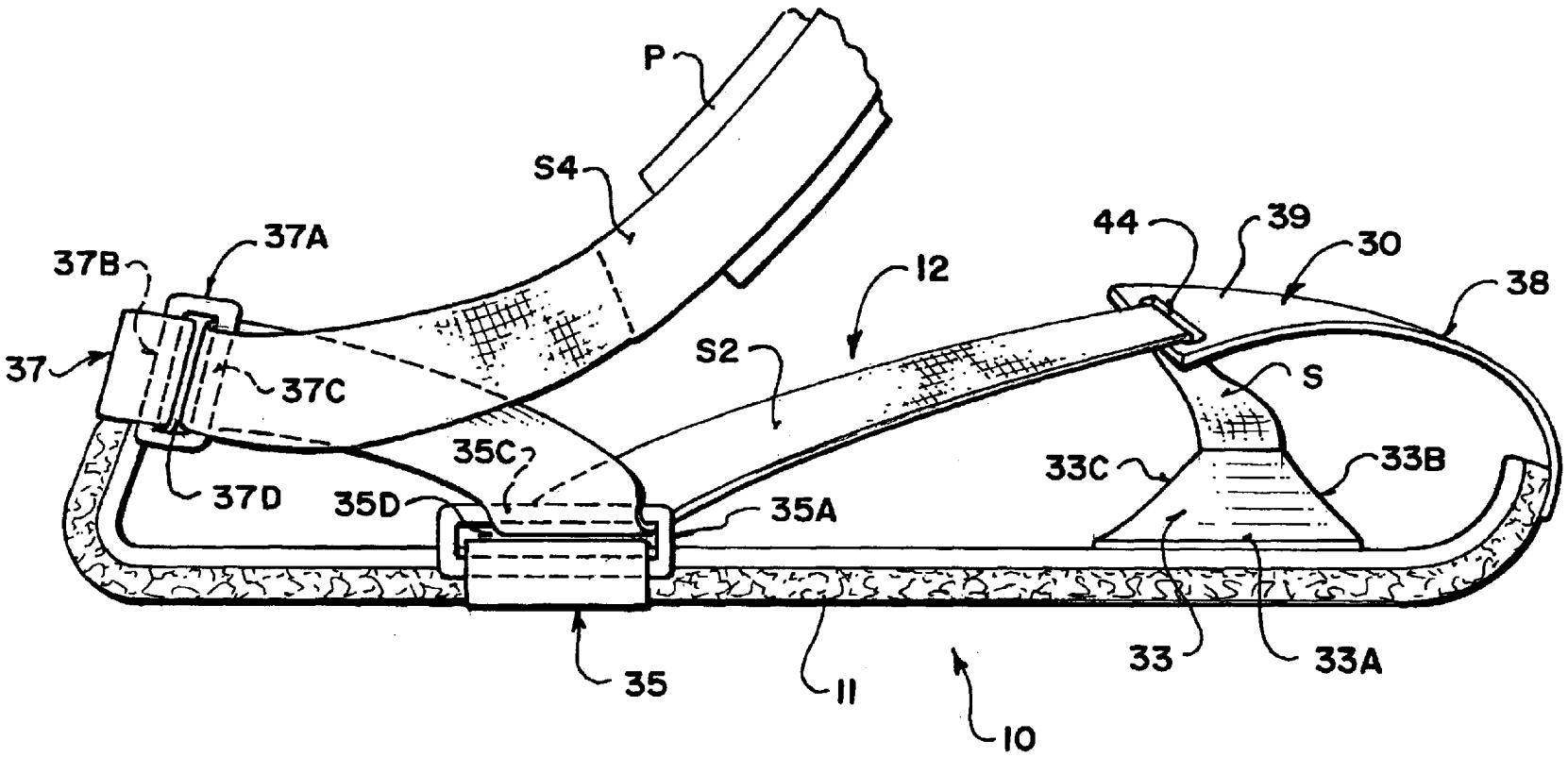
FIG. 4 is a side elevational view of the embodiment of FIG. 1.

As yet further arrangement shown in FIGS. 2, 3 and 4, the tight side 11A of the matting is adhesively attached to a sheet 11F of a suitable resilient material such as rubber so that the sheet is independent of the matting but is adhesively attached to the matting so as to form a laminated structure. The application of the gel coat or the attached rubber layer assists in providing integrity to the matting and may provide an increased wear resistance.

Figure 5:
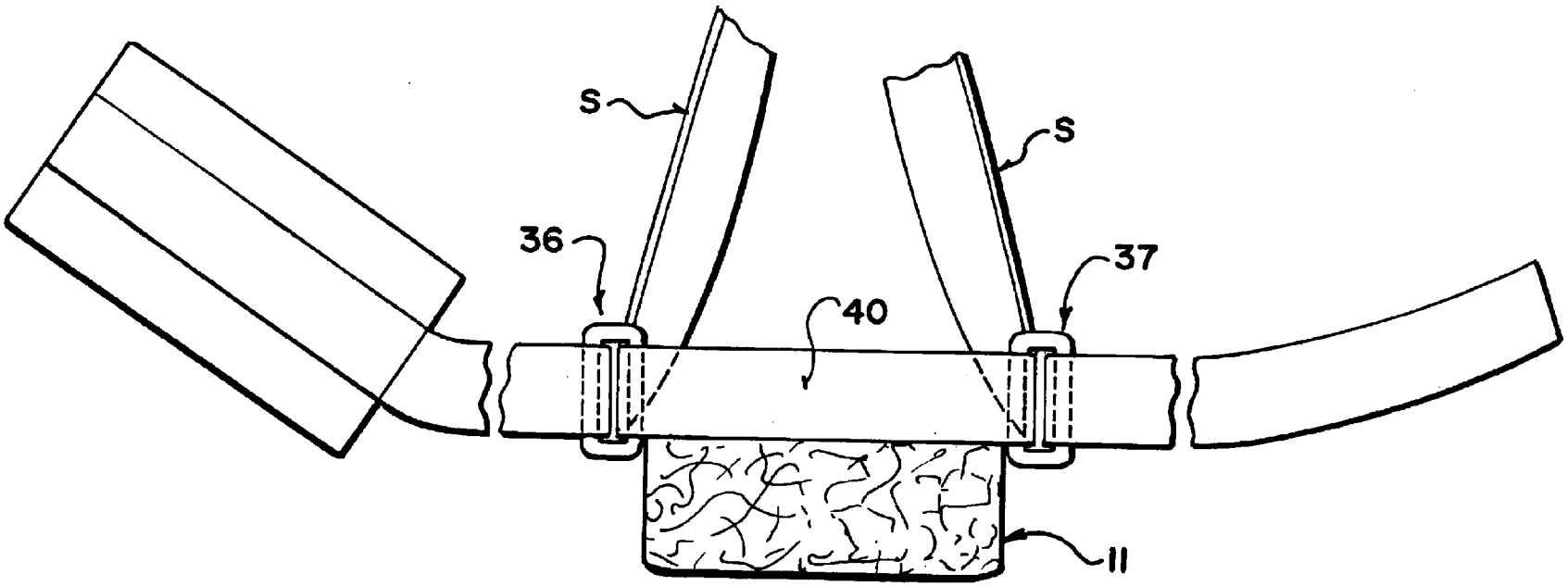
FIG. 5 is a rear elevational view of the embodiment of FIG. 1.

Turning now to the details of the strap shown in the first embodiment best shown in FIGS. 1, 4 and 5, the mat 11 has attached thereto a co-connector 30 centrally of the toe and lying on a centre line 31. On each side adjacent the toe is provided front side connectors 32 and 33. Adjacent the heel on each side is provided a rear side connector 34 and 35. At the heel is provided two heel connectors 36 and 37. The toe connector 30 includes a rearwardly extending strap portion 38 which then diverges into a generally triangular section 39 having an apex 40 lying on the centre line 31 and two side surfaces 41 and 42 extending outwardly and forwardly from the apex 40 so as to be inclined toward the respective side connector 32, 33. Adjacent each side 41, 42 is provided a slot 43, 44. The toe connector 30 can be formed from a suitable flexible sheet material such as leather or can be moulded as an injection moulded article defining the slots 43 and 44.

The side connectors 32 and 33 are each shaped so they have a wide edge 33A at the periphery 15 of the mat 11 and then converge to the width of the strap defining converging side edges 33B and 33C. As shown in FIG. 3 the side connector 33 is stitched onto the top of the mat 11 onto of the layer 11F by stitches 33D. The strap S is stitched also into the structure and attached to the side connector. Thus the increasing width of the side connector at the peripheral edge 15 provides more stability than would merely the width of the strap at the same location due to the increased length of contact in-between the side connector 33 and the peripheral edge 15.

The side connectors 34 and 35 and the heel connectors 36 and 37 are basically of the same construction in that each comprises a slide or ring 35A, 37A defining two parallel rods 37B, 37C interconnected to form a space 37D therebetween. As best shown in FIG. 2, the connector 35 includes the rod 35B which is attached to the edge 15 of the mat by a stitched loop 35F attached by stitches 35E. The rod 35B thus lies parallel to the side edge 15 so that the rod 35C is spaced outwardly from the side edge leaving the space 35D therebetween.

As the slide or ring 35A is attached at the side, the rod 35C is parallel to the side edge and thus horizontal along the side edge.

As the slide or ring 37A is attached at the heel which is pulled up behind the heel of the shoe of the wearer so as to stand upwardly from the horizontal section of the mat, the rod 37C is also parallel to the side edge but the side edge itself is vertical at that point and so the rod 37C is also vertical.

It will be noted that the rod 35A is longer than the width of the strap S whereas the rod 37C is substantially equal to the width of the strap S. The length of the rod 35C accommodates the inclined passage of the strap S through the opening 35D.

As shown in FIG. 5, the connectors 36 and 37 are attached to the heel portion which is pulled up behind the shoe by a transverse strap 40 which is stitched to the heel portion and wraps around the rod of the respective slid or loop forming the connector. This holds the connectors firmly attached across the rear of the heel and transfers load from the straps to the whole of the transverse rear edge of the heel portion of the mat.

The strap S2 which is connected to the front side connector 33 by the stitches 33D and additional stitches 33DD extends from the side connector 33 to the slot 44 where in passes through the slot from the underside onto the top of the toe connector 30 at the slot and then extends rearwardly from the slot 44 to the underside of the rod 35C where it passes under the rod to the outside of the connector and then over the rod towards the rear connector 37. At the rear connector the strap S2 passes from the inside of the rear connector rod 37C to the outside where it forms a free end connector S4. Symmetrically the strap S1 passes from the connector 32 through the slot 43 to the connector 34 and the connector 36 forming a free end S3. The free end S3 includes a pad P which contains a resilient material thus reducing pressure against the foot of the wearer when the free ends S3 and S4 are connected over the foot as shown in FIG. 4. The end connectors are connected by male and female hook and loop strips as indicated at M and F at the ends of the straps S2 and S1 respectively.

The strap arrangement shown allows the pad to be held in place under the foot of the wearer and connected together by a simple pulling action which tensions all of the elements of the straps. The toe area of the mat is held in place by the engagement around the toe portion of the sole of the shoe by the connectors 30, 32 and 33. The heel portion is held in place by being pulled up around the back of the heel of the shoe and is held pulled up by the upward pulling action of the ends of the strap which engage over the shoe of the wearer at the front of the foot. The wrapping of the straps through the side connectors 34 and 35 maintains that area of the mat pulled up against the underside of the sole and restricts side to side movement in that area.

Also shown in FIG. 1 in phantom is an insert 50 which is arranged to be placed between the sole of the shoe and the upper surface of the mat. This insert is shown in cross section in FIG. 6 and comprises a thin flat sheet of suitable material which can flex with the mat so that it does not interfere with operation of the mat but which has sufficient stiffness to remain flat between the mat and the shoe. The sheet is indicated at 51 and carries a plurality of studs 52 each having a head 53 attached to the sheet by a backing plate 54 and a stud portion 55 which extends from the sheet to one side of the sheet to an end 56 of the stud. The studs 52 are arranged in an array over the sheet primarily under the sole area of the shoe. The sheet 51 has a shape so that it matches the shape of the mat and therefore sits within the area confined by the connectors and by the upturned heel portion.

The mat has a series of holes punched therethrough at locations arranged to coincide with the positions of the studs on the sheet 51. Thus the insert can be readily placed into its required position on the mat simply by placing the sheet 51 over the mat and by pushing the studs through the holes 57 formed in the mat. This operation can be carried out readily and manually when required. The studs 55 have a length so that there end 56 lies just at the bottom surface 11B of the mating or very slightly proud of the surface of the mating. Thus as shown in FIG. 6, the studs just provide an engagement surface defined by the ends 56 which is proud of the surface 11B allowing those ends to engage into or onto a slippery surface such as ice. However the fact that the ends 56 are adjacent the surface 11B ensures that the surface 11B also provides support for the wearer so that the wearer is not supported solely upon the studs.

The insert can therefore be placed onto the mat when required for frictional engagement with slippery surfaces such as ice or snow. However the main support of the wearer remains on the mat itself rather than on the studs so that some resilient effect still occurs through the mat even when the studs are biting into the underlying slippery surface.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. Apparatus comprising:

a foot shaped base layer shaped and arranged to fit under the sole and heel of a shoe of a wearer;

an upstanding toe connection member standing upwardly from the base layer at a fowardmost toe end of the base layer so as to stand upwardly in front of the shoe of the wearer;

an upstanding heel connection portion standing upwardly from the base layer at a rearwardmost heel end of the base layer so as to stand upwardly behind the shoe of the wearer;

two forward side connection members one on each side at a forward location on the side of the base layer so as to be located to a respective side of the of the shoe of the wearer;

and two rearward side connection members one on each side at a location on the side of the base layer rearward of the forward location so as to be located to a respective side of the of the shoe of the wearer;

and straps connected between the toe connection member, the heel connection portion, the two forward side connection members and the two rearward side connection members for wrapping around the shoe of the wearer for attachment of the base layer to the foot of the wearer underneath the shoe of the wearer;

wherein the base layer composes a resilient anti-fatigue mat defined by resilient polymer fibers heat bonded together.

2. The apparatus according to claim 1 wherein the base layer consists solely of the mat of fibers.

3. The apparatus according to claim 1 wherein the mat of fibers includes a tight surface where the fibers are more tightly bonded together and a loose surface where the fibers include loose strands and wherein the loose surface is arranged to engage the ground.

4. The apparatus according to claim 1 wherein on each side a single strap connects from the forward side connection member to the toe connection member and from the toe connection member to the rearward side connection member.

5. The apparatus according to claim 1 wherein on each side a single strap extends from the forward side connection member through a slot at the toe connection member, and from the toe connection member through a slot at the rearward side connection member, and wraps over the shoe.

6. The apparatus according to claim 1 wherein the forward side connection members each include a portion which increases in width from the strap to the side of the base layer so as to define a width at the base layer which is wider than the strap to provide increased stability.

7. The apparatus according to claim 1 wherein the mat of fibers is bonded to an upper resilient layer for engaging the bottom of the shoe.

8. The apparatus according to claim 7 wherein the upper resilient layer is a layer of rubber bonded to the fibers.

9. The apparatus according to claim 7 wherein the upper resilient layer is a coat into which the upper fibers are incorporated.

10. The apparatus according to claim 1 wherein the toe connection member comprises a single member generally central of the forwardmost toe end which extends from the base layer over the toe of the shoe of the wearer rearwardly of the forwardmost to toe end to a rear strap engaging portion.

11. The apparatus according to claim 10 wherein the rear strap engaging portion includes two connecting elements inclined to a center line such that two of the straps respectively attached thereto extend therefrom rearwardly and outwardly.

12. The apparatus according to claim 11 wherein the two rear connecting elements comprise two slots such that the two straps pass through respective ones of the two slots and extend from the forward side connection members to the rearward side connection members.

13. Apparatus comprising:

a resilient foot shaped base layer shaped and arranged to fit under and cover the sole and heel of a shoe of a wearer for contacting the ground when the wearer is standing, the base layer having an upper surface and a lower surface a plurality of holes therethrough at spaced positions across the layer with each hole extending through from the upper surface to the lower surface;

straps connected to a front end, a rear end and sides of the base layer for wrapping around the shoe of the wearer for attachment of the base layer to the foot of the wearer beneath the sole and heel of the shoe of the wearer;

and an anti-slip insert comprising a thin, generally flat, flexible support member having an upper surface and a lower surface and a plurality of studs projecting from the lower surface of the support member, the support member being shaped and arranged to be located between the base layer and the shoe;

the studs being arranged at spaced positions across the support member such that, with the lower surface of the support member being in contact with the upper surface of the base layer, each of the studs projects through a respective one of the holes;

and the studs having a length such that ends of the studs contact the ground when the wearer is standing and such that the lower surface of the base layer also contacts the ground when the wearer is standing to provide support for the wearer so that the wearer is supported partly on the studs and partly on the resilient base layer.

14. The apparatus according to claim 13 wherein the studs have a length such that they just extend beyond the lower surface of the base layer.

15. The apparatus according to claim 13 wherein the support member in plan has a shape generally matching that of the base layer.

16. The apparatus according to claim 13 wherein the base layer comprises a resilient anti-fatigue mat defined by resilient polymer fibers heat bonded together.

17. The apparatus according to claim 13 wherein the base layer consists solely of the mat of fibers.

18. The apparatus according to claim 13 wherein there is provided an upstanding toe connection member standing upwardly from the base layer at a forwardmost toe end of the base layer so as to stand upwardly in front of the shoe of the wearer; an upstanding heel connection portion standing upwardly from the base layer at a rearwardmost heel end of the base layer so as to stand upwardly behind the shoe of the wearer; two forward side connection members one on each side at a forward location on the side of the base layer so as to be located to a respective side of the of the shoe of the wearer; two rearward side connection members one on each side at a location on the side of the base layer rearward of the forward location so as to be located to a respective side of the of the shoe of the wearer; and straps connected between the toe connection member, the heel connection portion, the two forward side connection members and the two rearward side connection members for wrapping around the shoe of the wearer for attachment of the base layer to the foot of the wearer underneath the shoe of the wearer.

19. The apparatus according to claim 18 wherein on each side a single strap extends from the forward side connection member through a slot at the toe connection member, and from the toe connection member through a slot at the rearward side connection member, and wraps over the shoe.

20. The apparatus according to claim 18 wherein the forward side connection members each include a portion which increases in width from the strap to the side of the base layer so as to define a width at the base layer which is wider than the strap to provide increased stability.

* * * * *